United States Patent [19]

Chambley et al.

[11] 4,198,735

[45] Apr. 22, 1980

[54] METHOD FOR FORMING TEMPORARY FABRICS

[75] Inventors: Phillip W. Chambley; Alan H. Norris, both of Rome, Ga.

[73] Assignee: WWG Industries Inc., Rome, Ga.

[21] Appl. No.: 891,307

[22] Filed: Mar. 29, 1978

[51] Int. Cl.[2] ..... D06P 7/00; D02J 1/08; D02J 1/16

[52] U.S. Cl. ..... 28/218; 28/103; 28/219

[58] Field of Search ..... 156/153, 181; 28/103, 28/104, 218, 219

[56] References Cited

U.S. PATENT DOCUMENTS

| | | | |
|---|---|---|---|
| 3,120,733 | 2/1964 | Breen . | |
| 3,391,048 | 7/1968 | Dyer et al. | 156/181 X |
| 3,439,394 | 4/1969 | Gray et al. | 28/103 X |
| 3,452,412 | 7/1969 | Allman, Jr. et al. | 28/104 |
| 3,607,567 | 9/1971 | Fairbanks | 156/181 X |
| 3,688,355 | 9/1972 | Okzaki et al. | 28/104 |
| 3,908,247 | 9/1975 | Murphy . | |
| 4,074,511 | 2/1978 | Chambley et al. . | |
| 4,104,855 | 8/1978 | Chambley et al. . | |
| 4,106,896 | 8/1978 | Norris et al. . | |

FOREIGN PATENT DOCUMENTS

| | | | |
|---|---|---|---|
| 742393 | 12/1955 | United Kingdom | 28/219 |

*Primary Examiner*—Robert Mackey
*Attorney, Agent, or Firm*—Beveridge, DeGrandi, Kline & Lunsford

[57] ABSTRACT

A temporary fabric is formed by joining groups of two or more yarn strands at a time together at various longitudinally spaced points, forming generally transverse lines of joined points across an array of a plurality of parallel strands. No weft or filler yarn is used. An apparatus for joining is disclosed including a drum having a plurality of abrasive rotating joining discs in the surface thereof. A second embodiment includes joining discs moved transversely across a plurality of longitudinally traveling strands. The fabric can be separated into individual strands by pulling the strands apart.

6 Claims, 8 Drawing Figures

FIG. 3
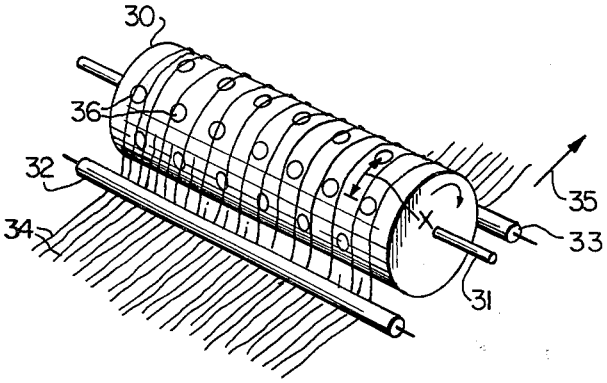
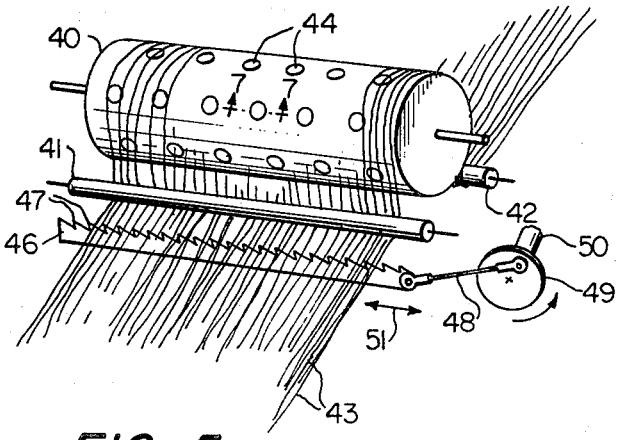
FIG. 5
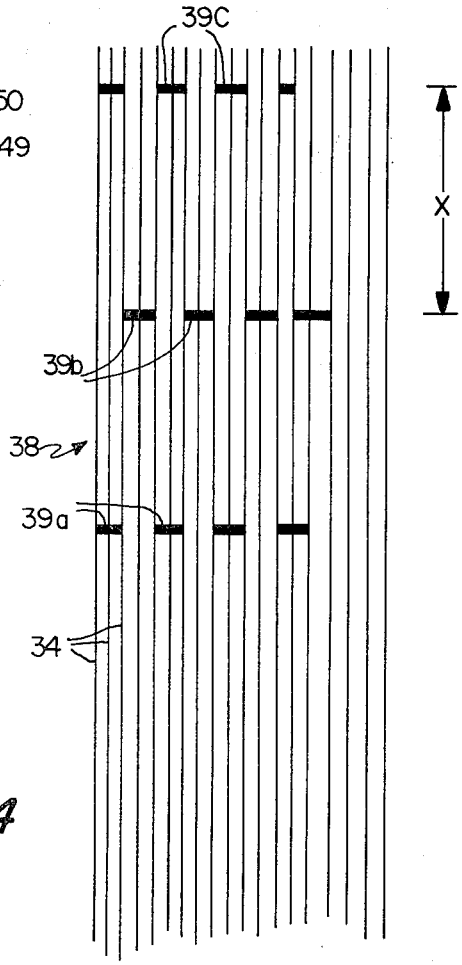
FIG. 4

METHOD FOR FORMING TEMPORARY FABRICS

This invention relates to forming a temporary fabric, or pseudo-fabric, to facilitate and improve yarn processing.

BACKGROUND OF THE INVENTION

It is well known that various yarn processing steps, such as dyeing, steaming, washing, etc., applied to individual yarn strands passing through a continuous process machine cause the yarn to undergo changes, such as shrinkage, which are quite non-uniform. Because of the range of degrees of shrinkage and the difficulties of maintaining and controlling feeding tensions in a large number of yarns, there have been problems associated with excessive tension, causing reduced bulk and, in extreme cases, breakage; and also with excessive slack, permitting portions of the yarn to wind around processing rollers. These problems can exist in the same machine at the same time.

It is also desirable in some processing steps, such as "space dyeing", to be able to maintain a plurality of yarn strands (e.g., 20 to 80 strands at a time) in a predetermined relative relationship, rather than handling them completely independently or as a loosely organized bundle.

One solution which has been employed to overcome these and other problems is to form the warp yarns into a "temporary" fabric, i.e., a structure which is a fabric in the sense of having the structural characteristics of a fabric but which is not intended to stay in that form as a final product. One such "temporary" fabric is knitted material wherein the yarn is passed through a knitting machine and knitted into, e.g., a tubular form. The knitted tube is then dyed, steamed or otherwise processed, after which the tube is unraveled and the resulting yarn, which may have an intentional crimp therein, is available for incorporation in a true "end product". This is commonly referred to as "knit-deknit".

A similar solution is "weave-deweave" wherein weft or "filler" threads or yarns are woven into the warp yarns to be processed, usually forming a rather loosely woven "temporary" fabric. After processing, the filler is removed, leaving the treated warps available for production.

Yet another solution is to false-twist portions of yarns around portions of adjacent yarns, thereby forming a tubular structure resembling a tube of netting or chicken wire fencing (although not made of wire) which, after processing, is disassembled.

Examples of these processes can be found in the following U.S. Pat. Nos.:

3,012,303 Whitaker, et al
3,102,322 Whitaker
3,120,733 Breen
3,343,242 DeWitte
3,456,431 Fleissner
3,602,968 Adolff
3,605,225 Gibson, et al
3,908,247 Murphy
3,997,950 Gibson While these prior art solutions are apparently usable, it is necessary to form these temporary fabrics in a separate manufacturing step with the concurrent costs for rather complex equipment and labor. In the weave-deweave processes, the weft or filler itself represents considerable expense, not only in its purchase and use, but also in that the weft removal step is often the main limitation on the speed with which the web or tape can be dewoven and the yarn rewound.

BRIEF DESCRIPTION OF THE INVENTION

Accordingly, it is an object of the present invention to provide a method of forming a "pseudo-fabric" or temporary fabric tape or web in which yarns are maintained in substantially parallel relationship and adjacent yarns are joined together at spaced zones while maintaining the parallelism in a manner which renders them easily detachable, the pseudo-fabric then being available for processing after which the yarns can be easily and quickly separated for individual winding on cones and/or subsequent use, such as tufting into a carpet. No filler or weft is used.

A further object is to provide apparatus for performing the foregoing method at high speed and low cost and without the need for significant maintenance.

Briefly described, the invention includes a method of forming a temporary fabric and of treating yarn strands therein comprising the steps of providing more than two yarn strands; longitudinally moving and guiding the yarn strands along a path in substantially parallel, closely spaced relationship with each other; joining said strands together in groups by detachably connecting adjacent ones of the strands to each other in groups at selected longitudinally spaced zones to temporarily form a fabric while maintaining said strands in substantially parallel relationship; treating the fabric thus formed; and thereafter detaching the strands from each other.

The invention further includes an apparatus for temporarily forming a fabric from a plurality of yarn strands comprising means for guiding a plurality of longitudinally moving yarn strands in closely spaced substantially parallel relationship through a joining station, and means at said joining station for contacting adjacent ones of said strands, at least two at a time, and for detachably joining said strands together at the zones of contact.

In order that the manner in which the foregoing and other objects are attained in accordance with the invention can be understood in detail, certain advantageous embodiments thereof will be described with reference to the accompanying drawings, which form a part of this specification, and wherein:

FIG. 3 is a simplified schematic perspective view of a second embodiment of an apparatus usable to form a temporary fabric in accordance with the invention;

FIG. 4 is a schematic plan view illustrating a second embodiment of a temporary fabric in accordance with the invention;

FIG. 5 is a simplified schematic view of a third embodiment of an apparatus usable to form a temporary fabric in accordance with the invention;

Figure 1:
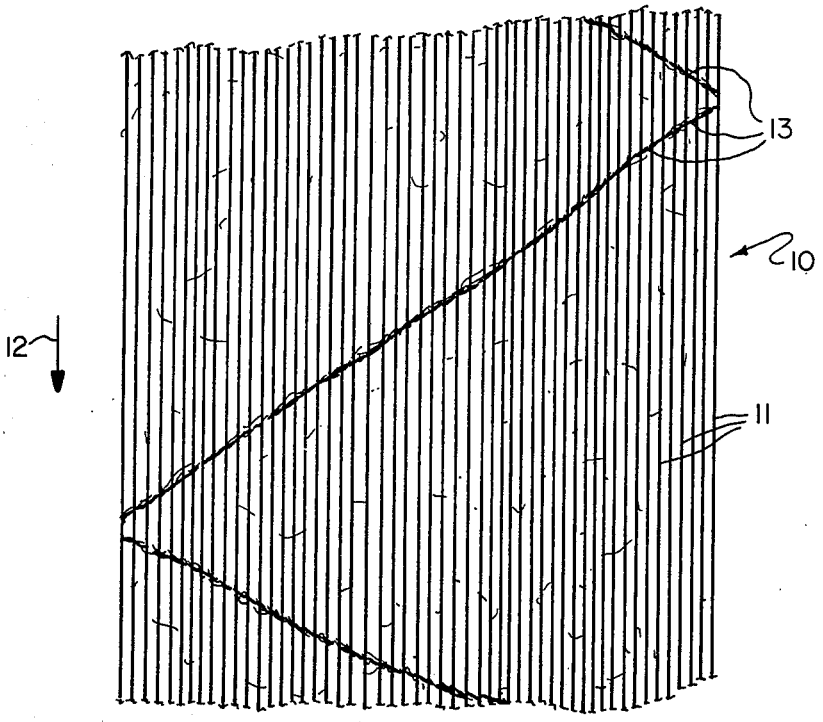
FIG. 1 is a schematic plan view of one embodiment of a temporary or pseudo-fabric formed in acordance with the invention.

A pseudo-fabric in accordance with the invention is formed by temporarily joining adjacent ones of a relatively large number of yarn strands together at longitudinally spaced points, and one embodiment of a temporary fabric, or pseudo-fabric, in accordance with the invention is shown in FIG. 1. The fabric 10 shown therein includes a plurality of yarn strands 11, a relatively short length of the fabric being shown. The yarn strands 11 are substantially parallel with each other and are maintained in parallel orientation during the formation of the temporary fabric and are continuously longitudinally moving in a direction as indicated by arrow 12. In order to form the fabric so that the strands are maintained in the desired relative relationship, joining points between the strands are formed, the joining points being indicated at 13 in FIG. 1.

In the specific embodiment illustrated in FIG. 1, the joining points form a series of generally diagonal lines extending transversely and longitudinally of the group of strands. It is critically important to note that the diagonal lines do not illustrate the existence of a separate filler or weft yarn and do not constitute a separate yarn of any kind. On the contrary, the joining points are formed by causing some of the fibers of the strands to be entangled with each other, causing a "lock" between adjacent strands which can be easily separated. More specifically, the fibers of two adjacent strands at a relatively small point compared with the total length of the strands are engaged by a joining device, such as an abrasive disc, and the fibers of these two adjacent strands are entangled or twisted with each other to cause them to hold together. Each such entanglement constitutes one of the joining points 13 and the sequence thereof forms the diagonal lines shown in FIG. 1.

It should also be noted that the particular arrangement of diagonal lines illustrated in FIG. 1 is by no means the only arrangement which can exist, and various arrangements of such locking points have been found to be satisfactory. Another arrangement which is suitable is that in which a plurality of diagonal lines of joining points is formed across the fabric with all of the diagonal lines extending substantially parallel with each other, and it is possible to form the joining points such that the diagonal lines begin at one side of the temporary fabric and are close enough so that a line extending across the temporary fabric perpendicular to the direction of movement would intersect a plurality of the diagonal joining lines.

Figure 2:
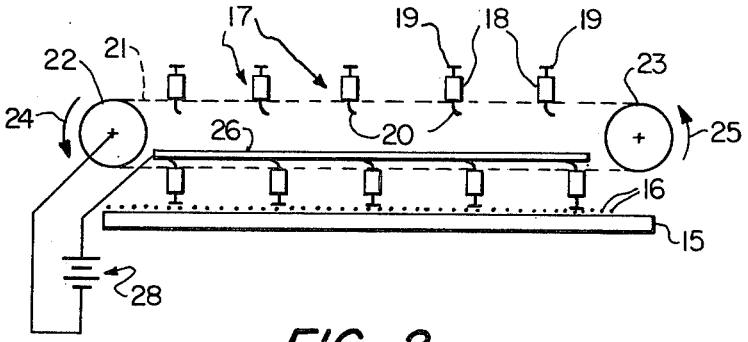
FIG. 2 is a schematic front elevation of one embodiment of an apparatus usable to form the fabric of FIG. 1.

An apparatus suitable for forming a temporary fabric in this fashion is schematically illustrated in a simplified form in FIG. 2 which shows a plate 15 which is stationary and which provides a support for a plurality of yarn strands 16 which are continuously longitudinally moved in parallel relationship across plate 15, similar to strands 11 as illustrated in FIG. 1. The joining function is performed by a plurality of joining devices indicated generally at 17, each of which includes a motor 18 having an output shaft carrying a disc 19. Each of the discs 19 has a high friction or abrasive surface (e.g., rubber or fine sandpaper) such that when it is brought in contact with a yarn strand, it tends to dislodge ends of fibers therein. When brought in contact with two such strands closely spaced, the dislodged fibers are caused to be entangled with each other, thereby accomplishing the locking. The entangling devices themselves will be described in further detail hereinafter.

Each of the motors 18 is provided with a protruding electrical contact member 20, these contact members being relatively light electrically conductive spring metal members which protrude from the motor and which are connected to one end terminal of its associated motor 18. The motors are mounted on one or a pair of chains 21 which are endless and are mounted on a pair of sprockets 22 and 23 driven by conventional drive means, not shown, in the direction of arrows 24 and 25. An electrically conductive bus bar 26 is mounted in fixed parallel relationship with plate 15 and is spaced therefrom so that when the motors are carried by the chain to a position between plate 15 and bus bar 26, the contacts 20 engage the undersurface of bus bar 26 and the faces of discs 19 engage the upper surfaces of the yarns 16. Bus bar 26 is connected to a source of power, illustrated schematically as a battery 28, the other side of the battery being electrically connected to the sprocket and chain assembly to which the other terminal of each motor is electrically connected. Thus, when each contact 20 makes electrical contact with bus bar 26, a circuit is completed between battery 28, through bus bar 26 and contact 20 to the motor and, through the chain and sprocket assembly, to the other side of the electrical source. Each motor is thus energized as it reaches bus bar 26 and remains energized, causing the discs 19 to rotate, until the motor reaches the other end of the bus bar, at which point the motor is deenergized.

From this description it will be recognized that the motors and their associated discs move transversely across the yarn strands which are simultaneously moving longitudinally. Thus, each disc describes a diagonal line across the array of yarn strands and the disc operates to sequentially join adjacent ones of the parallel strands at points along that diagonal line. With the number of motors and the yarn spacing schematically illustrated in the figure, it will be recognized that a relatively large number of diagonal lines of joining points will be formed across the strands. The process is, of course, continuous so that as long as yarn strands are supplied and as long as the motor system is operated, the pseudo-fabric will be formed.

It will be recognized also that a modification of a system like that shown in FIG. 2 can be made using a single motor and a drive which causes the motor and its associated disc to reciprocate back and forth across a plurality of yarn strands, the motor being carried either by a chain drive such as that illustrated or by any other convenient mechanical device causing reciprocatory movement. An apparatus such as this would form a series of lines of joining points similar to that shown in FIG. 1.

It will be observed that plate 15 can be mounted so that it is vertically adjustable to optimize the amount of contact between yarns 16 and discs 19.

A further embodiment of an apparatus usable to form a pseudo-fabric is shown in FIG. 3, this embodiment including a cylindrical shell 30, the axial length of which is greater than the width of the temporary fabric which is to be formed. The cylindrical body, which will be referred to hereinafter as a drum 30, is mounted on a shaft 31 which extends through the drum and is connected to driving means, not shown, for rotating the drum at a speed such that the peripheral speed of the drum matches the longitudinal speed of the yarns. Elongated guide rollers 32 and 33 are provided at the input and output sides of drum 30 to guide the yarns, the rollers being freely rotatable on axles which are mounted so as to lie in a plane below the axis of shaft 31. A large number of parallel yarns 34 are delivered under roller 32 and over drum 30, and then under roller 33, the yarns being continually longitudinally moving as indicated by arrow 35.

Drum 30 is provided with a plurality of circular openings arranged, in the embodiment shown, in axially extending rows. A disc 36 is mounted in each of these openings and connected to a motor, in a manner somewhat similar to the disc and motor devices shown in FIG. 2, so that each disc is substantially flush with the peripheral surface of the drum. The motors are energized such that the discs rotate at a relatively high speed about axes which lie on radii of drum 30. Thus, as the yarns pass over the drum, adjacent ones thereof are engaged and joined by the discs. A plurality of rows of openings and discs can be provided with the discs in each row axially offset from those in the adjacent rows, as illustrated. The circular or peripheral distance between adjacent rows is identified as a distance X in FIG. 3, this distance defining the longitudinal length between joining points.

A fabric formed using a device such as that shown in FIG. 3 is schematically illustrated in FIG. 4 at 38, a plurality of yarns 34 being joined at points 39, the joining points in this arrangement being such that they lie along line perpendicular to the longitudinal dimension of the yarns. As will be recognized by comparing FIGS. 3 and 4, joining points **39*a* are formed by one axial row of discs, joining points 39*b* by the next axial row, offset from the first, and joining points 39*c* formed by the next, etc. It will also be observed that the distance X between lines of joining points is the same as the distance X indicated in FIG. 3**.

It will further be observed that the number of rows of discs on drum 30 and the diameter of the drum can be varied depending upon the nature of the yarn being handled, the nature of the processing to which the temporary fabric is to be subjected, and the speed of longitudinal movement of the yarn in the overall system, and that the formation of the fabric in no way limits the system's speed.

A further embodiment of an apparatus for forming a fabric similar to that shown in FIG. 4 is shown in FIG. 5 wherein a drum 40 is rotatably mounted in a manner similar to drum 30 with rollers 41 and 42 which act in a manner similar to rollers 32 and 33 of FIG. 3. Yarns 43 are supplied, in continuous longitudinal movement, under roller 41, over drum 40 and under roller 42. Drum 40 is also supplied with rows of joining discs 44, but in this embodiment the drum can be supplied with one or more rows of joining discs for which the axial spacing can be greater than in the embodiment of FIG. 3. Also, the discs need not be axially offset from each other but can be aligned in circular planes.

As shown in FIG. 5, an additional mechanism is included to move the yarns laterally, this mechanism including an oscillating traverse bar 46, the bar being mounted in suitable guides, not shown, for longitudinal sliding movement in a direction perpendicular to the longitudinal direction of movement of the yarn. Bar 46 is disposed under the yarns and the upper edge thereof is provided with a plurality of teeth or serrations 47, the number of serrations being at least as great as the number of yarns being handled. One end of bar 46 is pivotally connected to a link 48, the other end of which is attached to an eccentric point on a drive wheel 49 which acts as a crank and which is connected to a drive motor 50 so that it continually rotates. As disc 49 rotates, the traverse bar reciprocates as indicated by arrow 51, causing the yarns to move axially with respect to drum 40. By this movement, sets of yarns are engaged by the joining discs and then the entire set of yarns is moved laterally, or axially with respect to the drum, so that those yarns not previously contacted by discs are moved into positions to be engaged by the discs while those previously joined by the discs are moved to the spaces between discs. This permits a reduction in the total number of discs used on the drum and produces a temporary fabric similar to that shown in FIG. 4. As will be recognized, more than two yarns may be engaged by a disc at any one time and joined to each other thereby.

Figure 6:
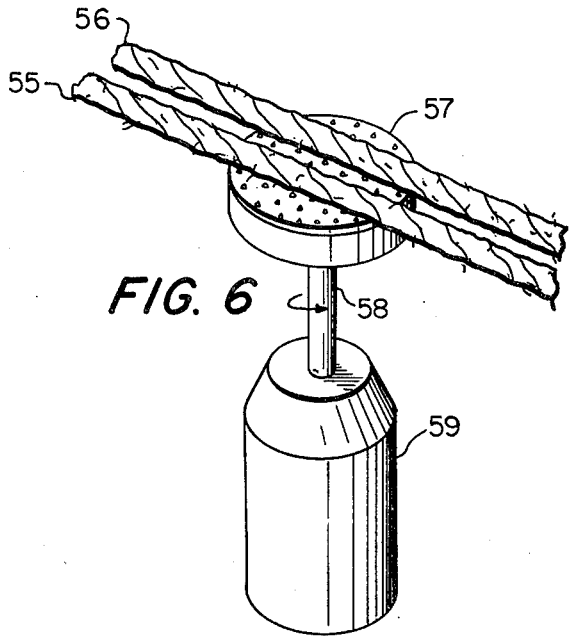
FIG. 6 is an enlarged perspective view of a yarn strand joining device usable in the apparatus of FIGS. 2, 3 or 5.
Figure 7:
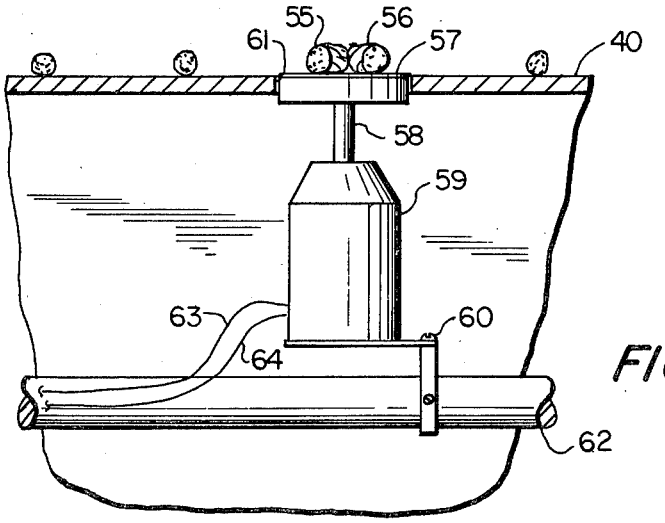
FIG. 7 is a partial sectional view along line 7—7 of FIG. 5.

FIGS. 6 and 7, show, in greater detail, the disc and motor assembly usable in the devices previously discussed. As shown in FIG. 6, yarns 55 and 56 lie across the surface of a disc 57 which is mounted on a shaft 58 for rotation therewith, shaft 58 being the output shaft of motor 59. This arrangement is illustrative of the relationship of these elements in any of the embodiments of FIGS. 2, 3 or 5, the motor being provided with contacts 20 in the event of use in an embodiment like FIG. 2.

In the case of FIG. 7, the assembly thus described is shown in the context of the embodiment of FIG. 5, although the structure would be the same in the embodiment of FIG. 3. Motor 59, as shown in FIG. 7, is provided with a mounting bracket 60 which is attached to the drum shaft for rotation with the shaft, the disc being disposed in a circular opening 61 in the shell of drum 40, the opening being slightly larger than the disc so that there is no frictional engagement therebetween. Electrical conductors 63 and 64 extend along the drum shaft and can be connected to a source of power by any convenient means such as conventional slip rings. As will be recognized, rotation of disc 57 causes entanglement of the fibers of yarns 55 and 56 and joining thereof.

Figure 8:
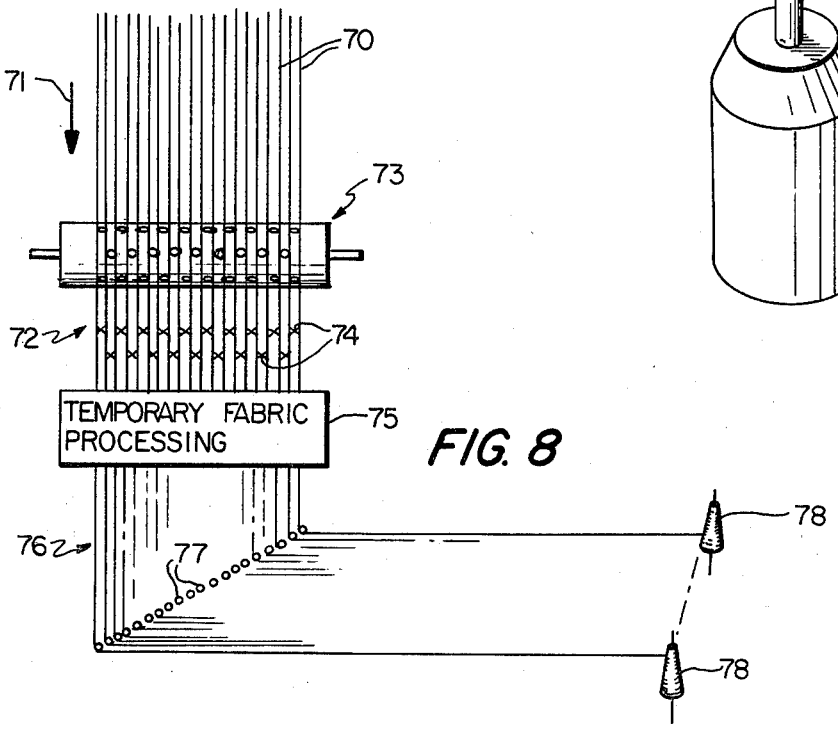
FIG. 8 is a schematic plan view of a processing system showing temporary fabric formation, processing and yarn separation.

FIG. 8 schematically illustrates an overall system for processing yarns employing the present invention. As shown therein, a plurality of yarns 70 are continuously longitudinally moved in the direction shown by arrow 71 and are formed into a temporary fabric indicated generally at 72 by a joining mechanism 73 which can be, for example, any of the devices shown in FIGS. 2, 3 and 5, but is illustrated as being similar to the device shown in FIG. 3. The joining points between strands, causing the formation of the fabric, is indicated at 74. The temporary fabric thus formed in subjected to processing, such as dyeing, this processing being illustrated as a block 75. The processing itself forms no part of the present invention and is therefore only schematically indicated. After processing, it is generally desirable to wind the yarns onto spools for subsequent use, or to separate the temporary fabric into individual yarns for direct delivery to apparatus for forming the yarns into a finished product, such as tufted carpet. It is an important aspect of the present invention that the temporary fabric is separable into the individual yarn strands quickly and easily.

As illustrated in FIG. 8, the processed temporary fabric 76 is delivered to a plurality of rollers 77 so that the yarns form right angles as they pass around these rollers. Rollers 77 can be mounted for free rotation about vertical axes, although this is by no means critical. As the yarns pass around rollers 77, the joined points 74 are separated so that the yarns are again individual strands. They can then be collected individually by winding on spools 78, or otherwise utilized.

As will be readily apparent, the separation process can be as fast as the remainder of the apparatus permits delivery of the yarn and winding on the spools, and the overall system speed is in no way limited by the separation process as is characteristic of weave-deweave or knit-deknit procedures.

While certain advantageous embodiments have been chosen to illustrate the invention, it will be understood by those skilled in the art that various changes and modifications can be made therein without departing from the scope of the invention as defined in the appended claims.

What we claim is:

1. A method of forming a temporary fabric and of treating yarn strands therein comprising the steps of providing more than two yarn strands;

longitudinally moving and guiding the yarn strands along a path in substantially parallel, closely spaced relationship with each other;

joining said strands together in groups by detachably connecting adjacent ones of the strands to each other in groups at selected longitudinally spaced zones to temporarily form a fabric while maintaining said strands in substantially parallel relationship, said step of connecting adjacent strands to each other being performed by abrading the strands to dislodge ends of fibers therein and twisting the dislodged fiber ends from adjacent strands around each other;

treating the fabric thus formed; and detaching the strands from each other.

2. A method according to claim 1 wherein, in the step of joining the strands, the selected zones for each group are longitudinally spaced from the selected zones for other groups so that the temporary fabric thus formed has lines of joined zones extending diagonally relative to the path of travel.

3. The method of claim 1 wherein the connecting step is performed by contacting said strands with a friction surface and moving said friction surface relative to said strands.

4. The method of claim 3 wherein the movement is imparted to the friction surface by rotating the friction surface about an axis which is perpendicular to the strands.

5. The method of claim 4 including the step of moving the center of the friction surface with and at the same speed as the strands.

6. The method of claim 4 including the step of moving the center of the friction surface transversely across the strands during said joining step.

* * * * *